US005595134A

United States Patent [19]

Pete

[11] Patent Number: 5,595,134

[45] Date of Patent: Jan. 21, 1997

[54] TOWING SYSTEM FOR DREDGES AND METHOD FOR USING SAME

[76] Inventor: Ira J. Pete, 4411 Bayouside Dr., Chauvin, La. 70344

[21] Appl. No.: 396,472

[22] Filed: Mar. 2, 1995

[51] Int. Cl.[6] ..... B63B 21/66

[52] U.S. Cl. ..... 114/244; 114/250; 37/307

[58] Field of Search ..... 114/242, 244, 114/245, 250; 56/8; 37/307, 342, 343, 344, 323, 324

[56] References Cited

U.S. PATENT DOCUMENTS

| | | | |
|---|---|---|---|
| 281,905 | 7/1883 | Meinesz | 37/342 |
| 1,062,924 | 5/1913 | Mercer | 37/342 |
| 1,704,181 | 3/1929 | Dunn | 37/343 |
| 2,610,415 | 9/1952 | Glaser | 37/342 |

*Primary Examiner*—Sherman Basinger

[57] ABSTRACT

A towing arm assembly for use with a towing vessel has a towing arm support affixed to each side of the towing vessel. Each towing arm support receives in sliding engagement in a horizontal channel therein a pin connected to a proximal end of a towing arm. Each pin can be locked within the channel to prevent fore and aft motion of an associated towing arm. Each towing arm is connected at a distal end to a forced air dredging apparatus. The towing arms can be slid aft to allow any substantial amount of forced air from the dredging apparatus to remain clear of any stern propeller of the towing vessel. The towing arms can be slid forward to allow the dredging apparatus to be stowed near the stern of the vessel.

1 Claim, 12 Drawing Sheets

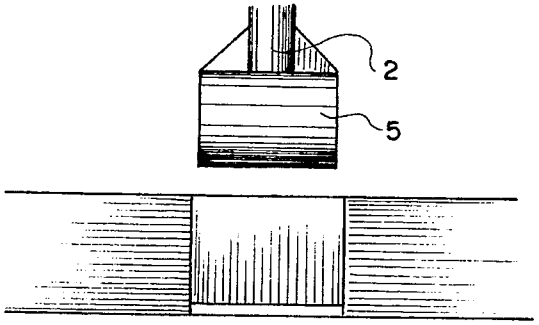
FIG. 14
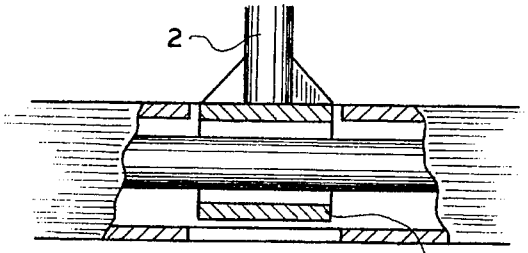
FIG. 15
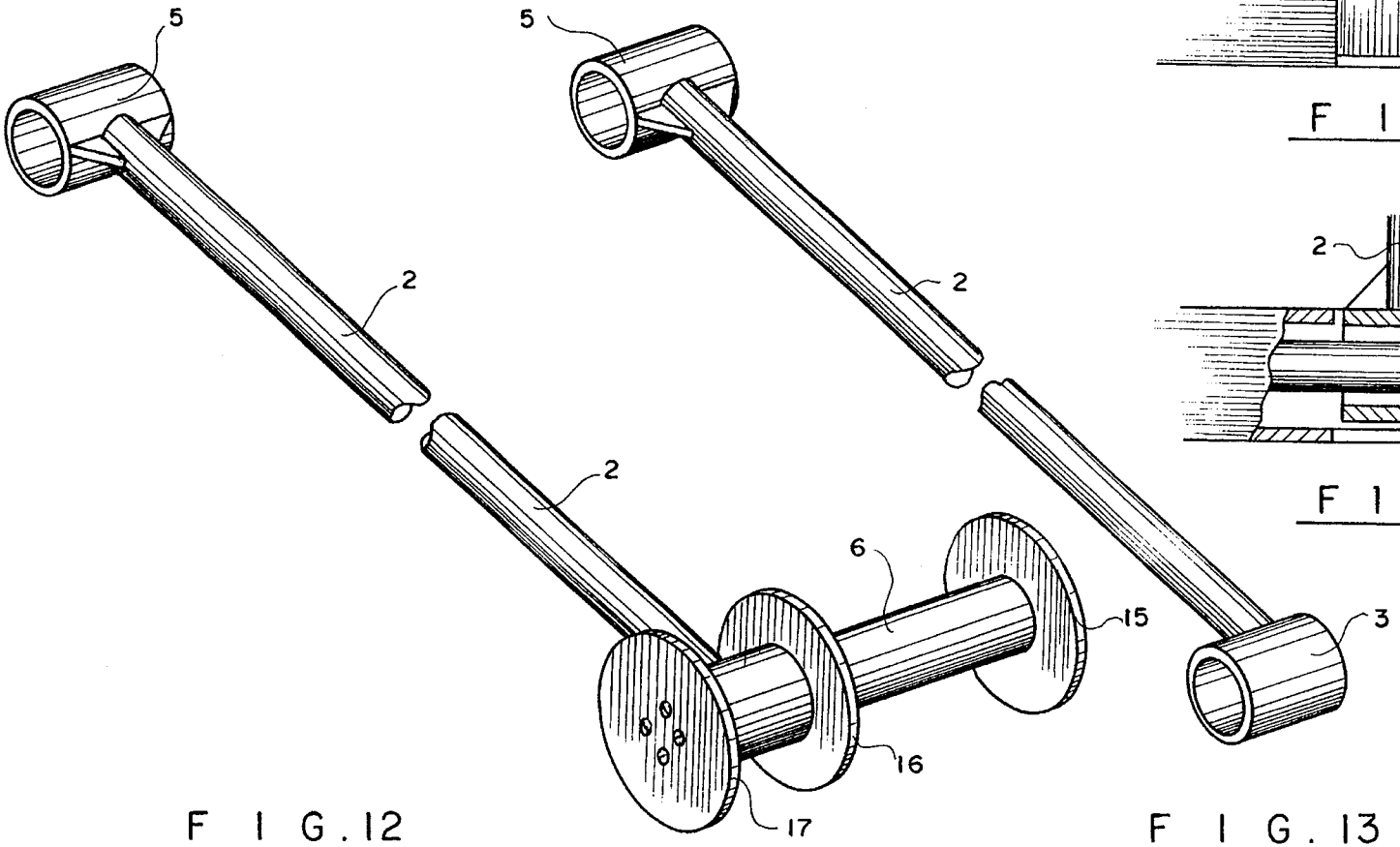
FIG. 13
FIG. 12

TOWING SYSTEM FOR DREDGES AND METHOD FOR USING SAME

BACKGROUND OF THE INVENTION

1. Field of the Invention

This invention relates to dredges and dredging vessels and, more particularly, to a towing arm assembly for towing a dredging apparatus employing forced air sufficiently far behind a vessel to avoid interference between rising air from the dredging apparatus and stern propellers of the towing vessel.

2. Background

In the past, various devices have been developed for deepening waterways, including rivers, channels, bays, lakes and sounds. After cutting or loosening bottom material, some means is required to move the material away from the location of the cutter. Conventionally, this is accomplished by suctioning or mechanically conveying the material away from the work area. The use of suctioning or mechanical transportation to remove material from the vicinity of the work area limits the useful working area. Various apparatus exist for enlarging the useful working area by modifying suction apparatus. However, limitations imposed by suctioning remain. Mechanical conveying of cut material is cumbersome.

Some dredging apparatus make use of forced air to stir and agitate cut water bottom material. The forced air tends to form bubbles which rise to the surface of the water body being dredged. If the means for dispensing forced air is too close to the stern of the towing vessel, the forced air rises and causes vibration problems to the vessel. Vibration problems are caused when the forced air bubbles up and meets the propeller blades. The resistance of water to a propeller spinning is greater than the resistance of air. Consequently, the propeller will tend to speed up in the presence of air bubbles and then slow down in the presence of water. Bubbling air around a spinning propeller causes repeated increase and decrease in speed of the propeller, usually expressed in revolutions per minute or RPM's. This repeated changing of speed of the propeller is known as cavitation and causes vibration to be transmitted through the propeller shaft to the clutch and to the stern of vessel. Metal fatigue can result if cavitation is unchecked for a sufficient time. Thus, some means and method which effectively overcome the problems encountered in using forced air in a dredge in proximity to the stern of a vessel, are desirable to facilitate dredging of water bottoms with dredging apparatus employing forced air.

SUMMARY OF THE INVENTION

To achieve the foregoing objects, and in accordance with the purposes of the invention as broadly described herein, a method is provided for maintaining a dredging apparatus employing forced air at a distance sufficiently far from the stern of a towing vessel to avoid any substantial amount of forced air from impacting the vessel propellers during operation of the dredge, the method comprising:

(a) lowering a dredge employing forced air to the bottom of a water body by pivoting a towing arm having one end pivotally connected to a towing vessel and having an oppositely disposed end connected to a dredging apparatus;

(b) moving the dredge away from the stern of the vessel by sliding the towing arm aft by moving aft a pin pivotally connecting one end of the towing arm to the vessel; and (c) maintaining the dredge at a distance sufficiently far behind the stern of the vessel to avoid any substantial amount of forced air from the dredging apparatus impinging upon the stern propellers of the towing vessel.

The present invention also provides a towing arm assembly adapted to connect a dredging apparatus to a towing vessel, the towing arm assembly including two arm supports disposed on opposite sides of the towing vessel for allowing towing arms to be received in fore and aft sliding engagement along the side of the towing vessel, each towing arm support having mounted therein in sliding engagement a towing arm pivotally connected at a proximal end to a towing arm support at the distal end and connected to a dredging apparatus, each towing arm having a locking member to lock the towing arm at a selective location along the towing arm support, and a winch or other means for sliding of each of the towing arms fore and aft to allow the towing arms to be positioned in the towing arm supports.

In a simple embodiment of the towing arm assembly according to the invention, there may be provided a towing arm shaft pivotally connected to a pin shaft, which pin shaft is maintained in fore and aft sliding engagement within a towing arm support. The towing arm support is mounted to the side of a vessel and has a bottom supporting structure over which the pin shaft slides and a top supporting structure to maintain the pin shaft in a fore and aft track. The towing arm and associated pin shaft are moved as a unit fore and aft by means of a forward cable and winch to pull the towing arm and associated pin shaft forward and an aft winch and cable for sliding the towing arm and associated pin shaft aft.

As the depth at which a water bottom is dredged increases, the dredging apparatus attached to the towing arm must be lowered. If the towing arm connected to the vessel were fixed and were not allowed any fore and aft movement, either the towing arm would be excessively long to allow dredging at a desired depth without causing cavitation problems or the dredge would be limited in the depth at which it could operate. The combination of allowing fore and aft motion of the towing arm where it is connected to the dredge vessel and the ability of the towing arm to pivot where it is connected to the vessel allows dredging to desired depths without the attended cavitation problem.

Therefore, it is an object of this invention to provide a towing arm assembly for use with dredging apparatus employing forced air. More specifically, an object of the invention is to provide a towing arm assembly which includes towing arms that are connected by means of towing arms supports to a side of a vessel, the towing arms being moveable fore and aft and pivotal at the connection to the vessel supporting structure.

Another object of the invention is to provide a method for dredging water bottoms at various depths using forced air while keeping the dredging apparatus far enough astern to avoid cavitation problems.

Another object of the invention is to provide a method for towing a dredging apparatus employing forced air without the necessity for telescoping towing arms.

Additional objects and advantages of the invention are set forth in part in the description which follows, and in part are obvious from the description of the invention or may be learned by practice of the invention. The objects and advantages of the invention may be realized and obtained by means of the articles, apparatus and methods particularly pointed out in the appended claims.

To achieve the foregoing objects, and in accordance with the purposes of the invention as broadly described herein, the towing arm assembly of the present invention comprises:

(a) two towing arm supports affixed to opposite sides of a towing vessel, each of the supports having a horizontal channel adapted to receive in sliding engagement a pin connected to a head of a towing arm, and each of the supports adapted for receiving a locking member to lock the pin within the channel, thereby preventing any fore and aft motion by the head of the towing arm;

(b) two towing arms, each comprising a tube and each having a pin rigidly connected thereto at a proximal end for sliding engagement within the channel of a towing arm support, and each of the towing arms being connected at a distal end to a dredging apparatus;

(c) two locking members, each adapted for locking the pin to one of the towing arm supports, to lock the pin within the channel at preselected locations to prevent fore and aft movement of the head of the towing arm;

(d) means for sliding each of the towing arms aft to allow a dredging apparatus connected thereto to be lowered sufficiently behind the stern of the towing vessel to allow any forced air from the dredging apparatus to remain substantially clear of any stern propeller of the vessel;

(e) means for sliding each of the towing arms forward to allow the dredge to be positioned near the stern of the vessel; and (f) means for raising and lowering the dredging apparatus.

BRIEF DESCRIPTION OF THE DRAWINGS

The invention can be understood by the following description in conjunction with the accompanying drawings in which:

FIG. 2(*a*) is a plan view showing a vessel with a towing arm on each side of the vessel and showing forward and aft positions of a dredging apparatus;

FIG. 12 is a broken, perspective view of a towing arm attached to a slide arm or pin;

FIG. 13 is a broken, perspective view of a towing arm;

FIG. 14 is a top view of a portion of a dredging apparatus showing a location for connecting an end of a towing arm thereto;

FIG. 15 is a top view of a portion of a dredging apparatus showing an end of a towing arm connected thereto;

DETAILED DESCRIPTION OF THE INVENTION

Figure 1:
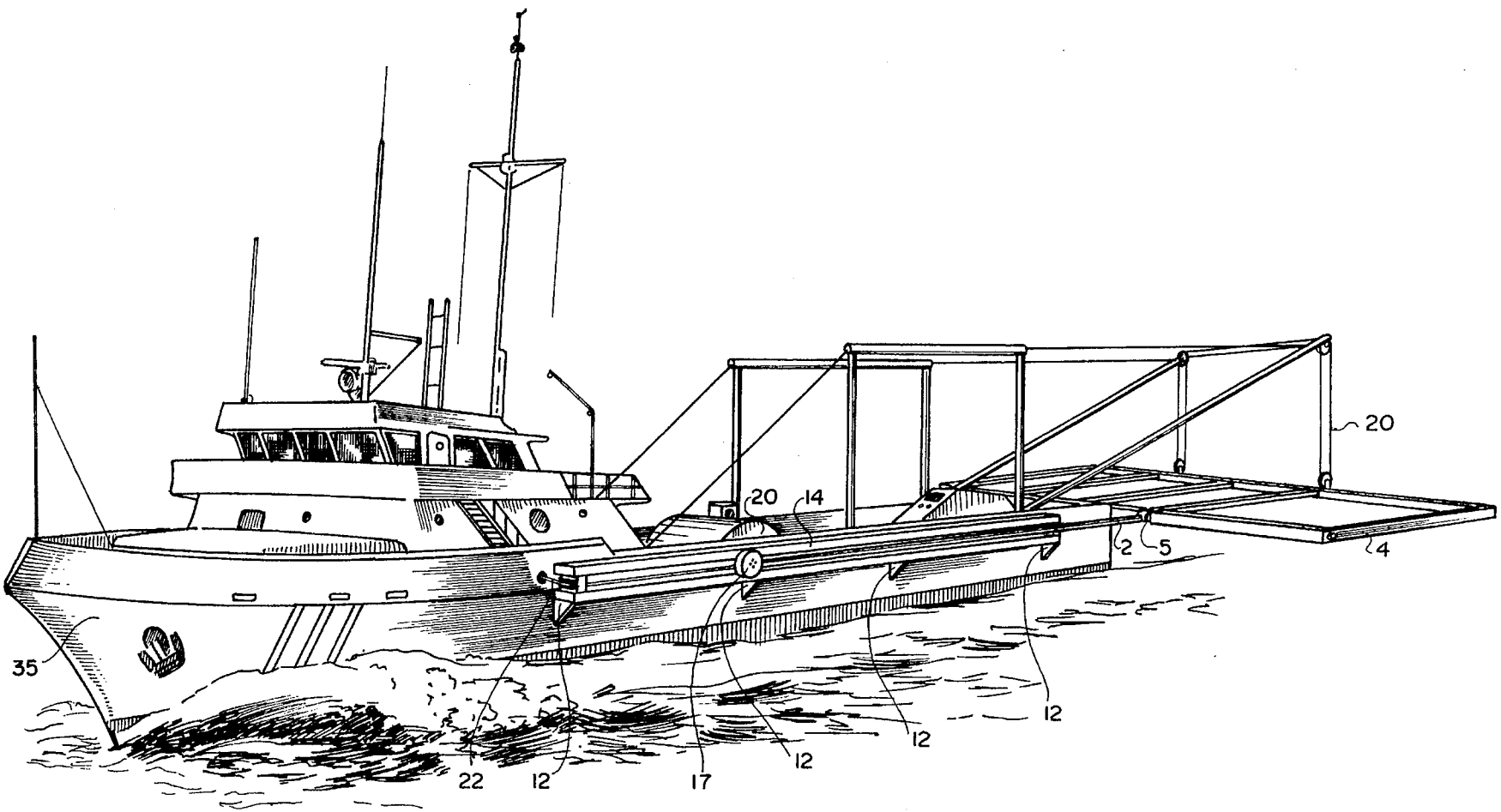
FIG. 1 shows a perspective view of the port side of a vessel showing an embodiment of a towing arm assembly according to the invention attached thereto.
Figure 2:
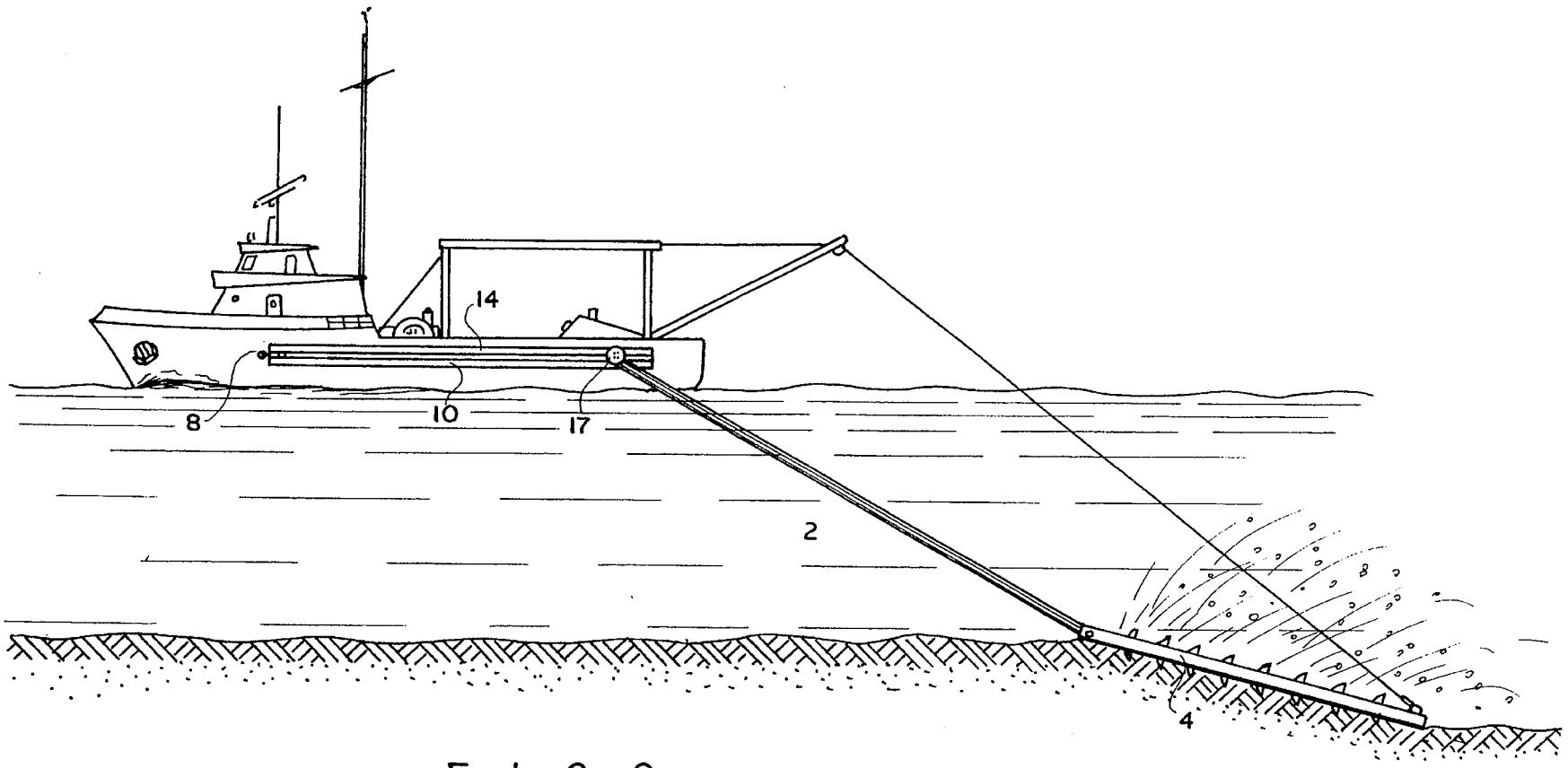
FIG. 2 is a perspective view of an embodiment of the towing system in accordance with the invention showing the towing arm assembly in an extended, working position.
Figure 2A:
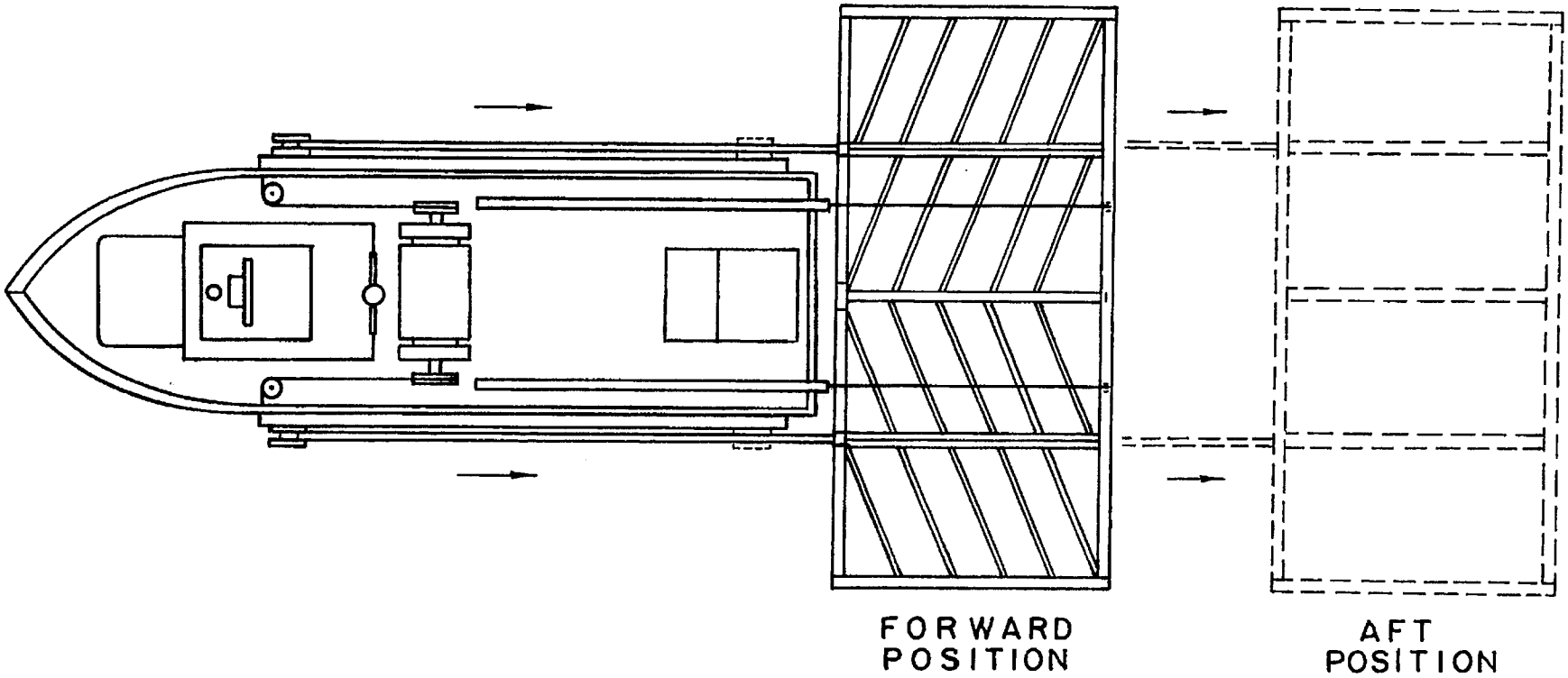
Figure 3:
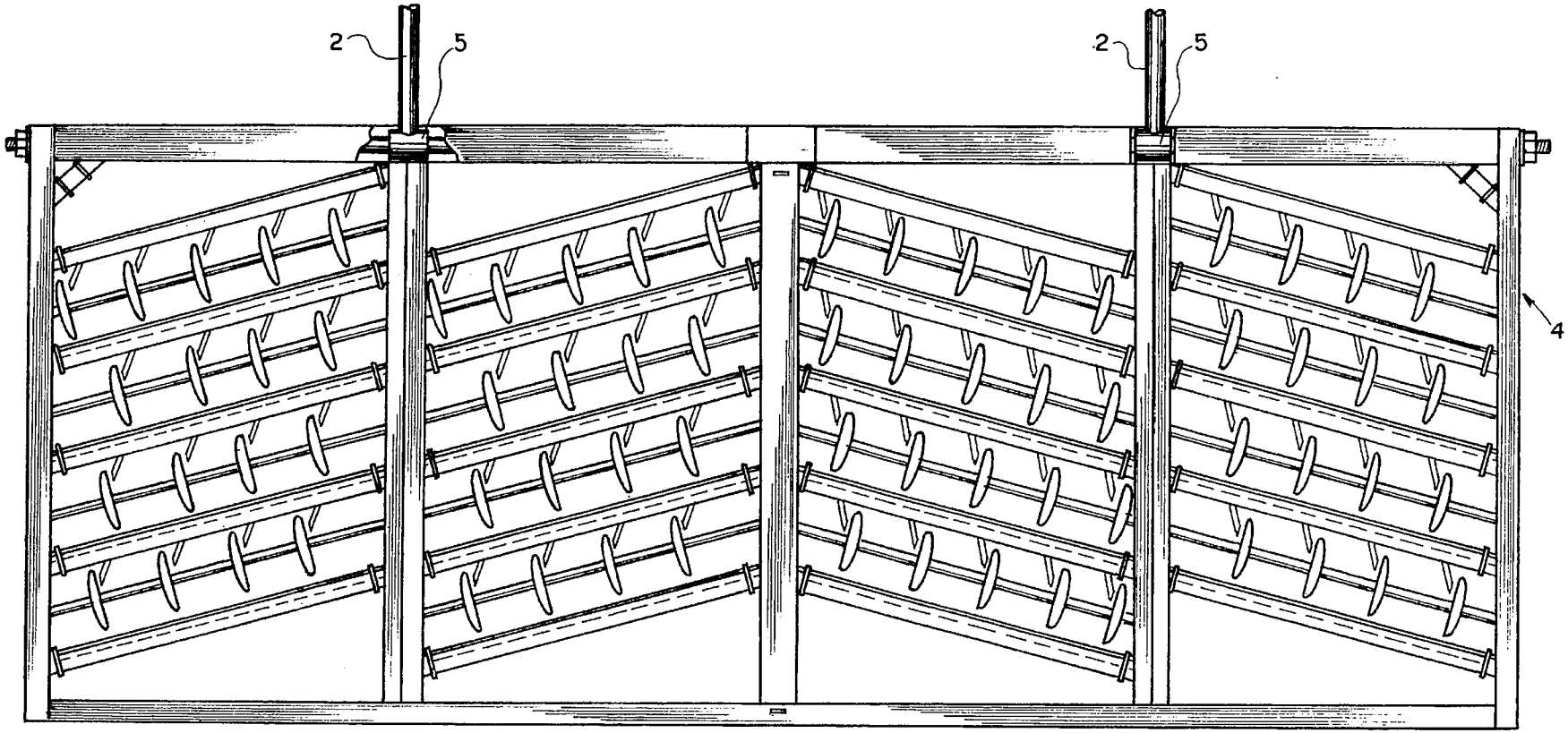
FIG. 3 is a plan view of a dredging apparatus in accordance with the invention.

In the description which follows, like parts are marked throughout the specification and drawings with the same reference numerals. The drawing figures are not necessarily to scale and certain features of the invention may be shown exaggerated in scale and in somewhat schematic form in the interest of clarity and conciseness.

Figure 4:
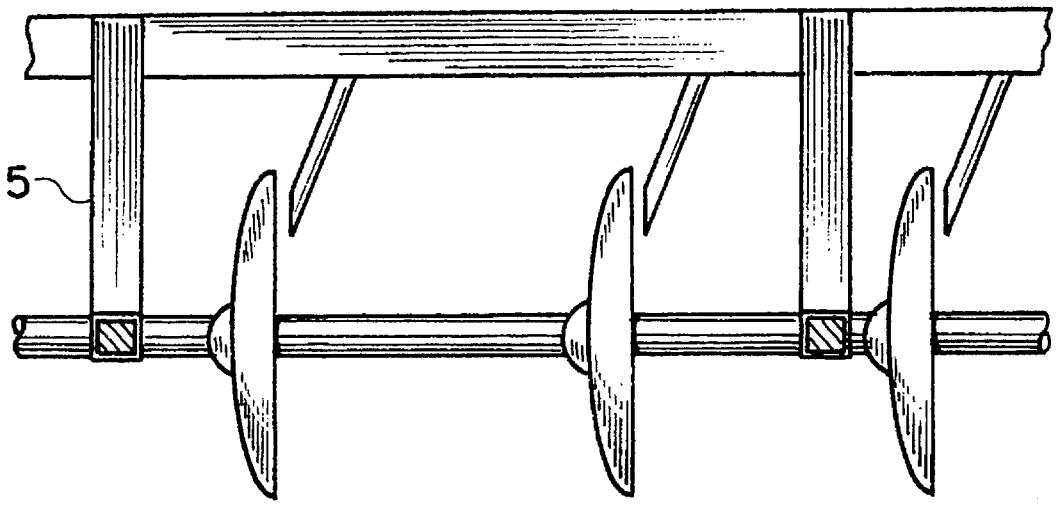
FIG. 4 is a view of a portion of the cutter blade assembly of the dredging apparatus of FIG. 3 showing scrapers for each of the cutter blades and a means for supporting the cutter blades in proximity to the scrapers.
Figure 5:
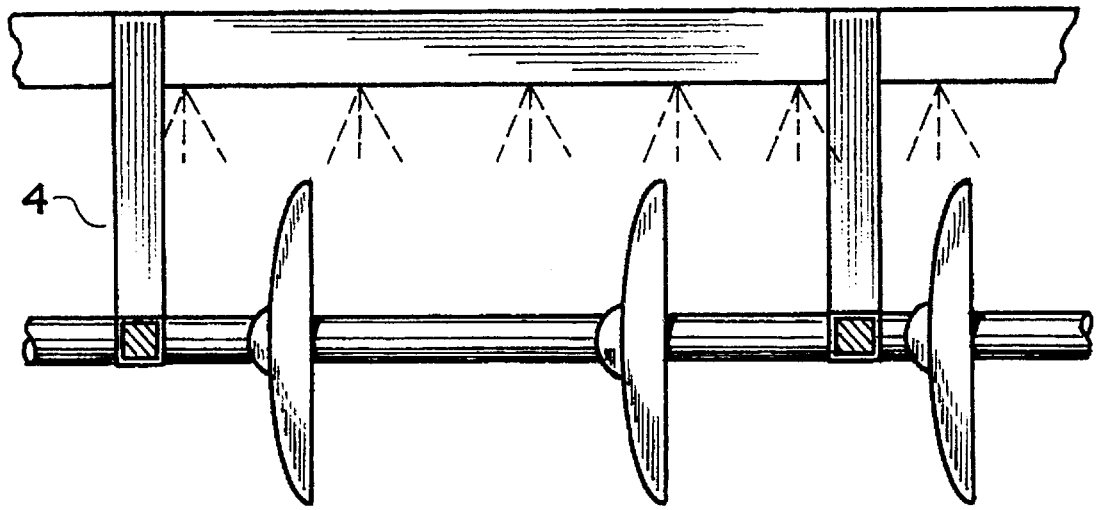
FIG. 5 is a side view of a portion of an alternative cleaning assembly of the dredging apparatus showing forced air in lieu of cutter blades.
Figure 6:
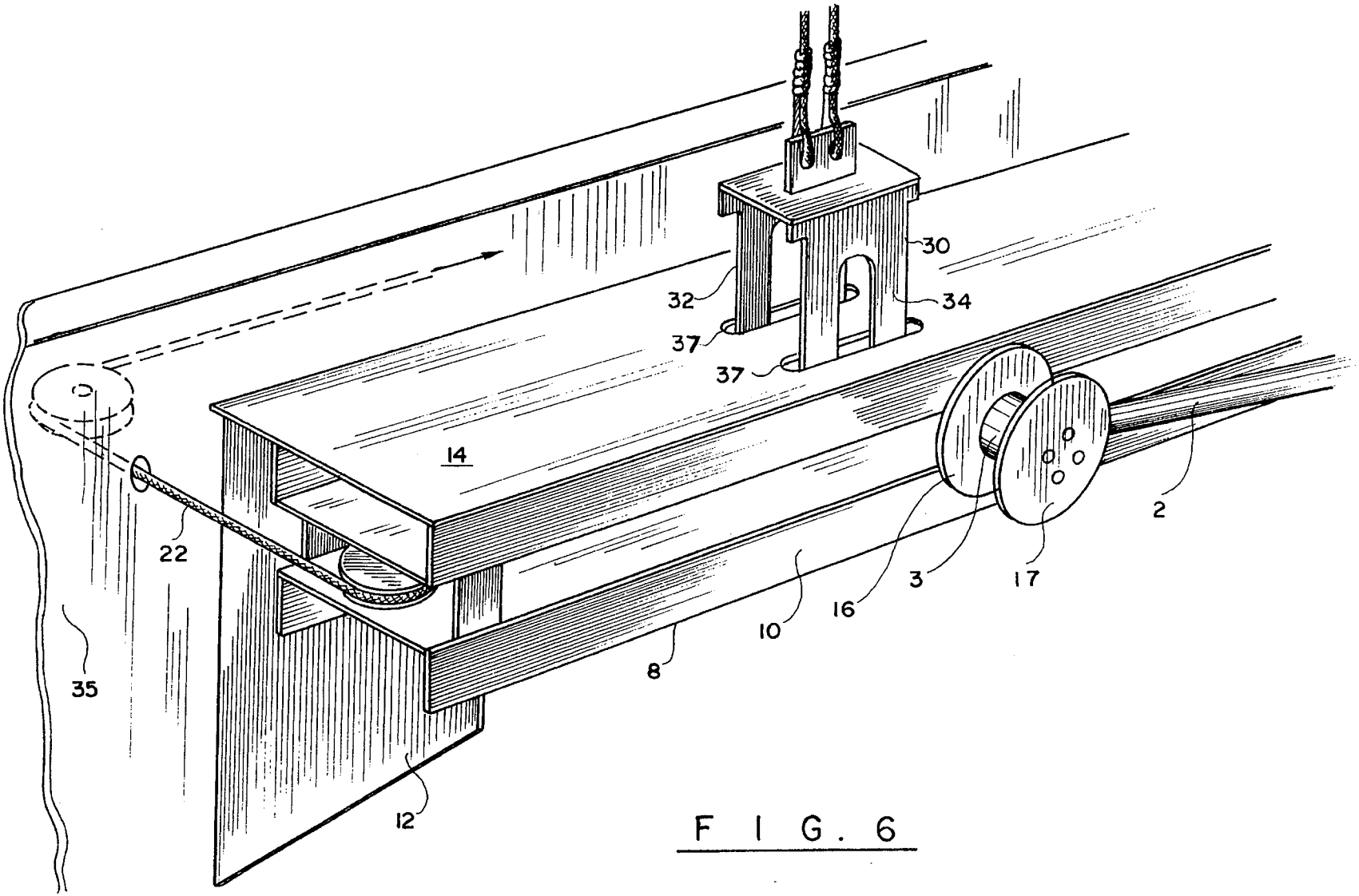
FIG. 6 is a perspective view of a forward portion of a towing arm support showing the support connected to a vessel hull and also showing locking means partially inserted into locking holes for locking a towing arm in place.
Figure 7:
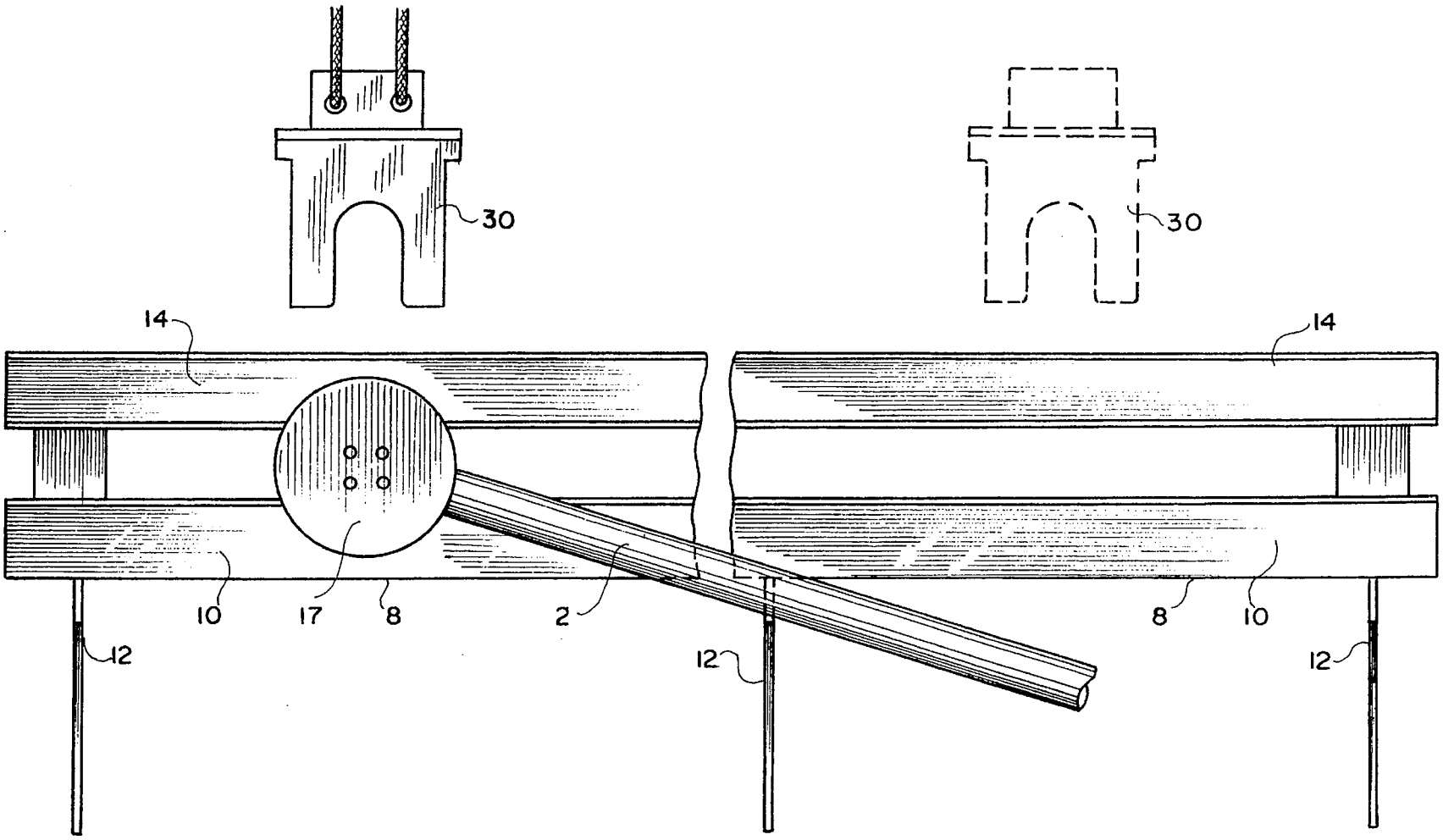
FIG. 7 is a side view of a towing arm support showing two locations for locking a towing arm in place.
Figure 8:
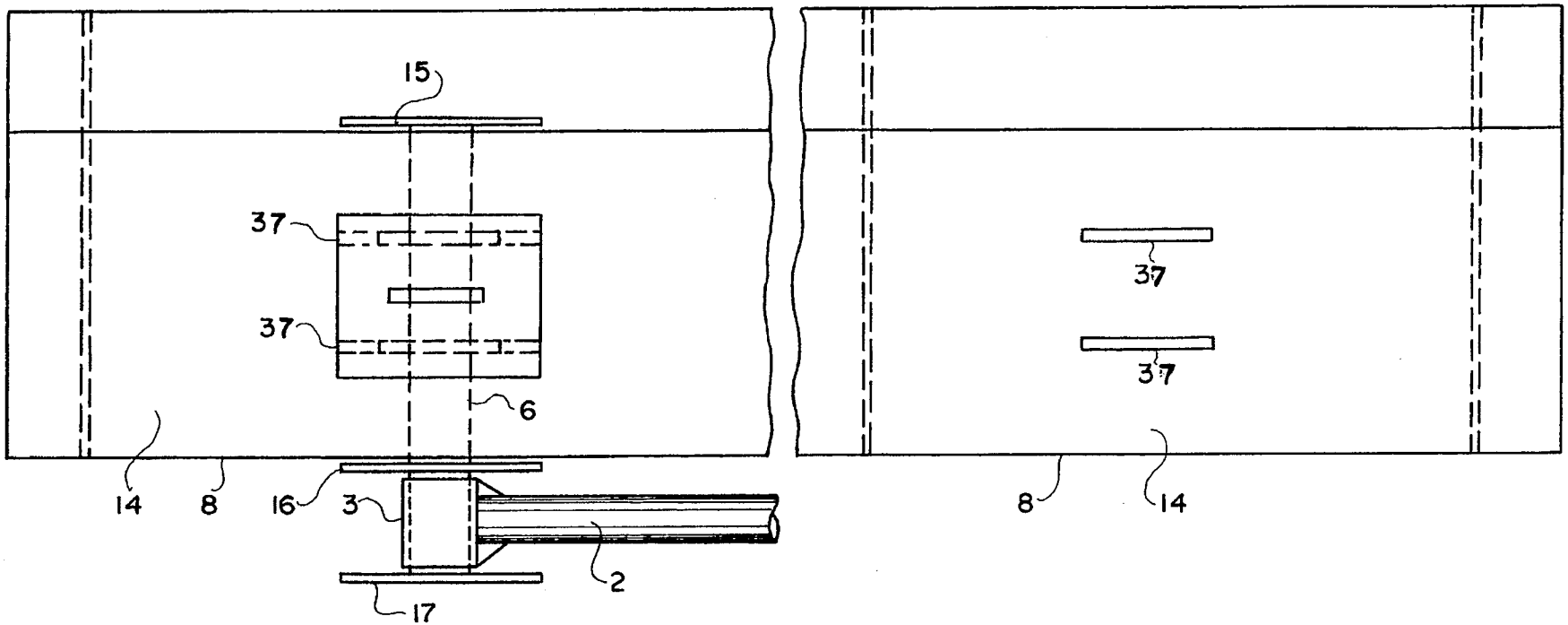
FIG. 8 is a top view of a towing arm support showing a towing arm in a forward working position.
Figure 9:
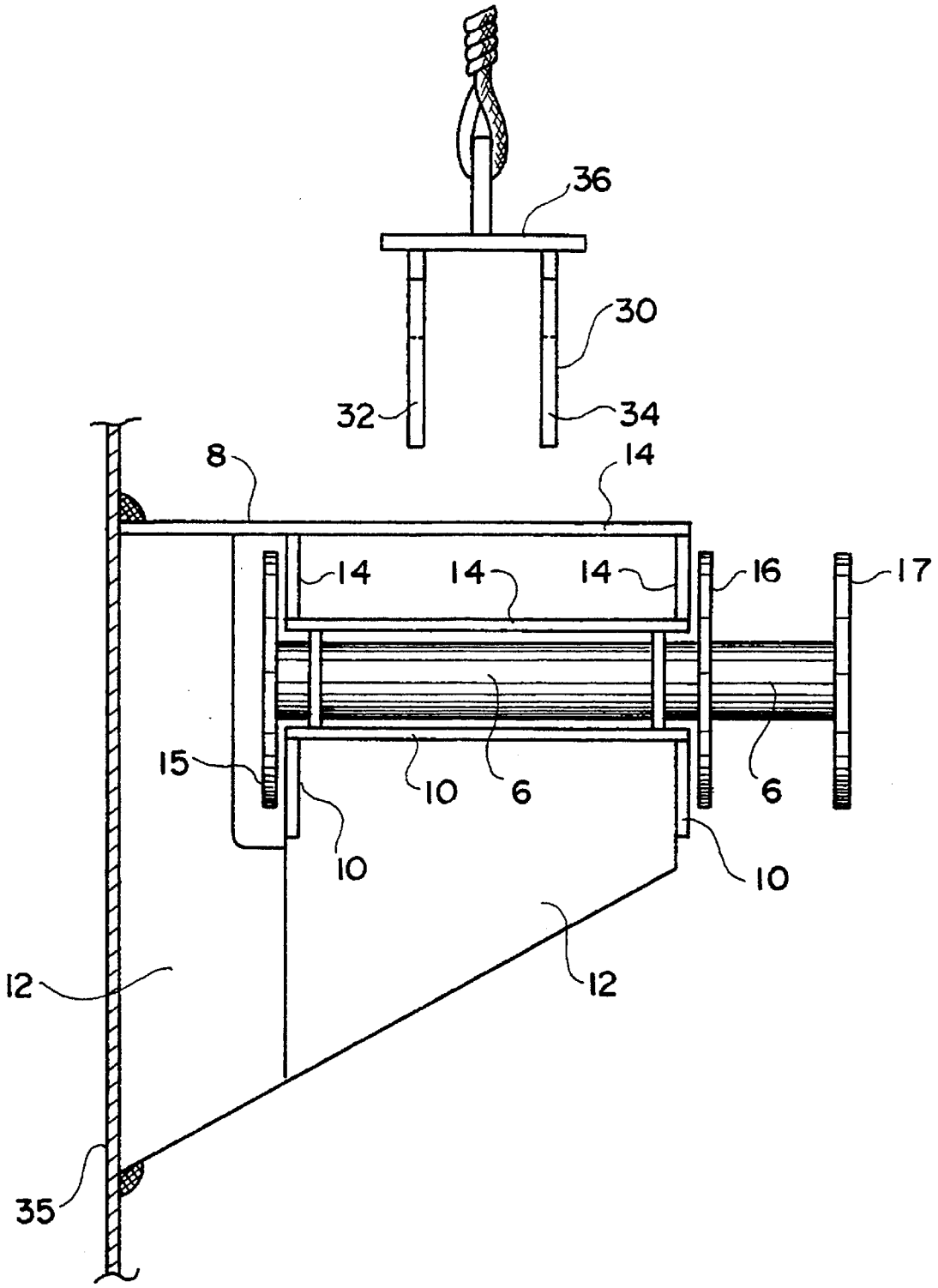
FIG. 9 is an end view of a towing arm support showing detail of the slide arm or pin of a towing arm within slides and also showing a gusset plate welded to a side of a towing vessel.
Figure 10:
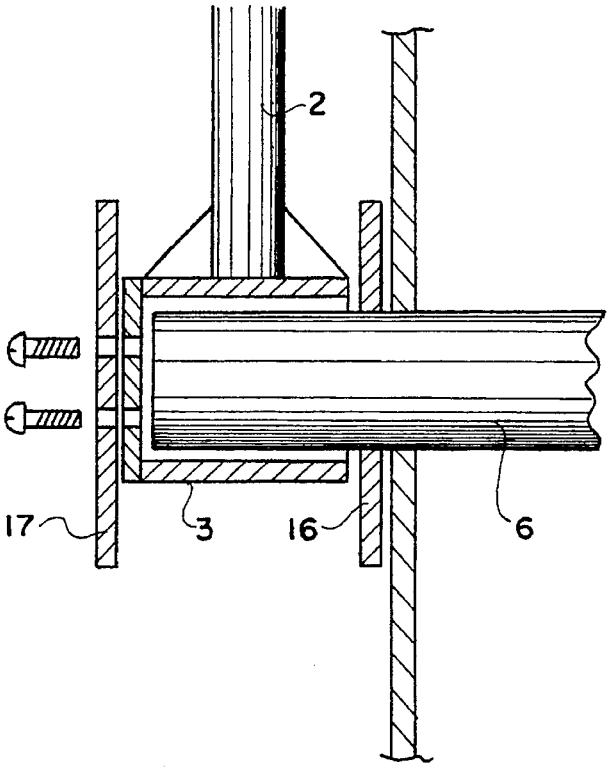
FIG. 10 is a forward view of a slide arm or pin showing a flange with a bolted connection.
Figure 11:
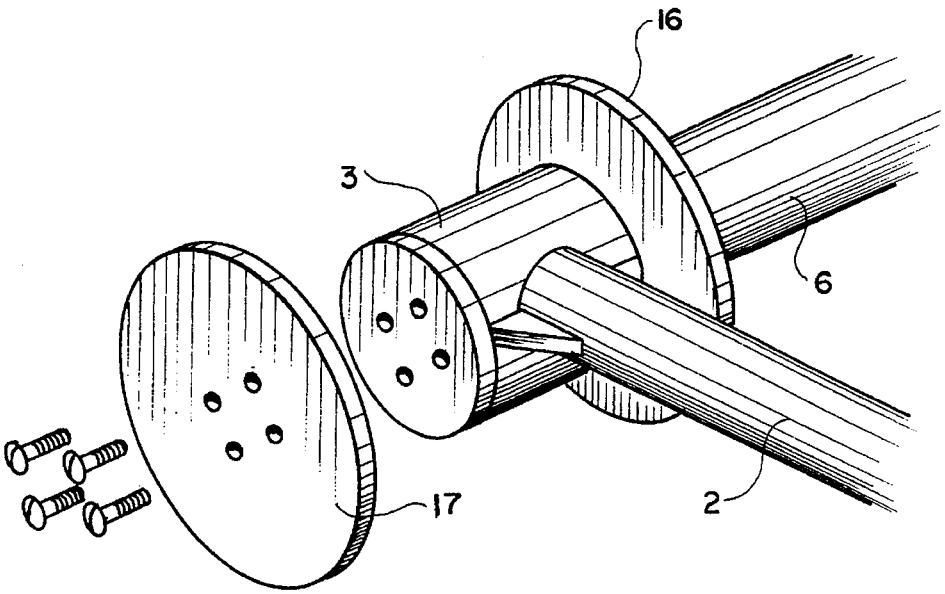
FIG. 11 is an exploded, perspective view of the slide arm or pin of FIG. 10.
Figure 16:
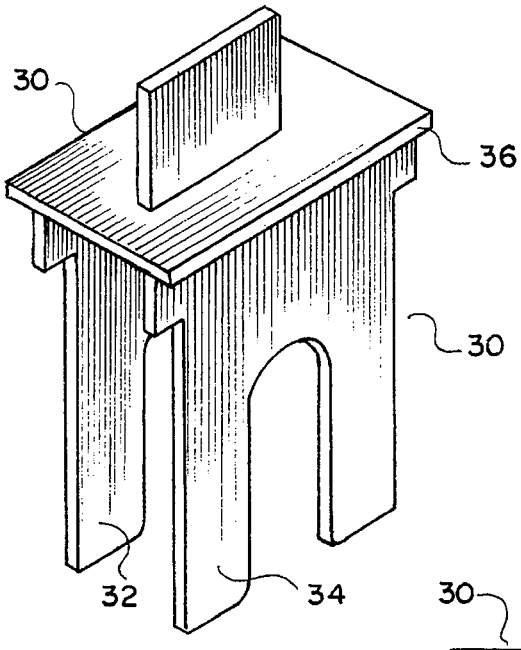
FIG. 16 is a perspective view of a locking key.
Figure 17:
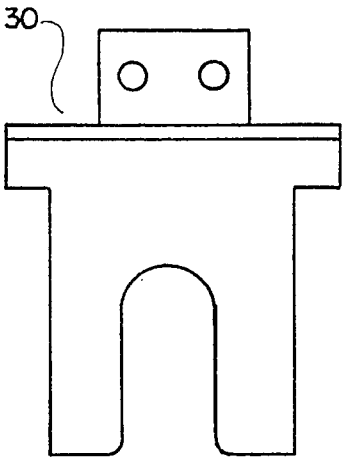
FIG. 17 is a side view of the locking key of FIG. 16.
Figure 18:
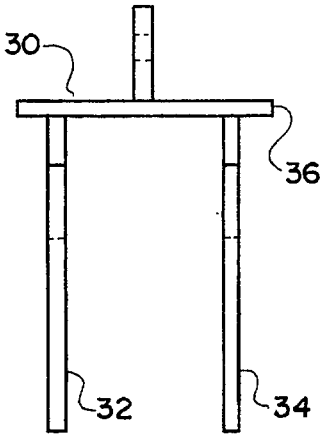
FIG. 18 is a forward view of the locking key of FIG. 16.
Figure 19:
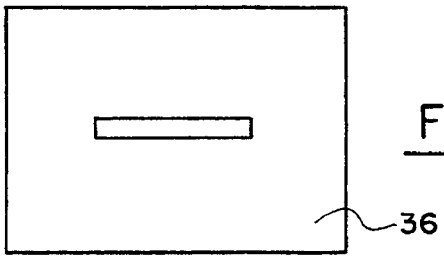
FIG. 19 is a top view of the locking key of FIG. 16.
Figure 20:
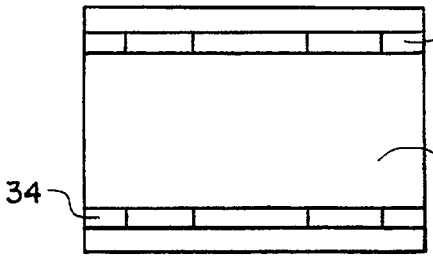
FIG. 20 is a bottom view of the locking key of FIG. 16

Referring to FIGS. 1 through 20, there is illustrated a preferred apparatus for towing a forced air dredging apparatus. FIG. 1 shows a towing arm on the port side of a vessel. Towing arm 2 is a pipe or tube having two ends denoted as a proximal end 3 and a distal end 5. In the description that follows, it must be kept in mind that the towing system is symmetrical and that another towing arm is similarly connected on the starboard side of the vessel. The distal end 5 is pivotally connected to forced air dredging apparatus 4, shown in FIG. 5, or alternatively to scraper dredging apparatus 5, shown in FIG. 4. The proximal end 3 of towing arm 2 is pivotally connected to slide arm 6. Slide arm 6 is supported within towing arm support 8, which comprises bottom slide 10, attached to gusset plate 12, and top slide 14 also attached to gusset plate 12. The upper surface of bottom slide 10 and the bottom surface of top slide 14 are substantially parallel and provide a cavity within which slide arm 6 may be slid. Slide arm 6 is preferably schedule 160 pipe and preferably has flanges 15, 16, and 17 connected thereto. Flanges 14 and 16 are sized so that they restrain any motion of slide arm 6 tending to move slide arm 6 toward or away from the hull of the vessel. Flanges 15 and 16 are preferably welded onto slide arm 6. Flange 17 is preferably bolted onto an end of slide arm 6 furthest from the hull of the vessel and operates in conjunction with flange 16 to restrain any side to side motion of towing arm 2 while permitting a pivotal connection of the proximal end 3 of towing arm 2 to slide arm 6. The pivotal connection of towing arm 2 to slide arm 6 allows the distal end 5 of towing arm 2 to be raised and lowered. Winching means 20 connected either to distal end 5 of towing arm 2 or to dredging apparatus 4 allows dredging apparatus 4 to be raised and lowered to desired depths while pivoting proximal end 3 of towing arm 2 on slide arm 6. When dredging apparatus 4 is lowered while a vessel is underway, dredging apparatus 4 moves astern of the vessel.

Dredging apparatus 4 is positioned at a desired depth and at a location sufficiently astern of the towing vessel to alleviate any cavitation problems. As dredging apparatus 4 is raised or lowered, lowering arm 2, including slide arm 6, moves forward or backward, respectively, within towing arm supports 8. The position of slide arm 6 is adjusted forward within towing arm supports 8 by winching cable 22 between a forward winch (not shown) and a forward portion of slide arm 6. Adjusting the position of slide arm 6 aft is accomplished by lowering dredging apparatus 4 while slide arm 6 is not locked in place and is free to move fore and aft. Slide arm 6 can be locked in place within towing arm support 8 by means of locking device 30. Locking device 30 is preferably two parallel plates 32 and 34 held apart by top plate 36. Parallel plates 32 and 34 have notches in a bottom portion thereof which notches are sized to permit locking device 30 to be inserted in spaced parallel holes 37 through top slide 14 and matching spaced parallel holes in bottom slide 10 to lock slide arm 6 in place at selected locations along towing arm support 8.

Locking device 30 is preferably inserted and removed from towing arm support 8 by means of a davit (not shown). Gusset plate 12 has one side welded to the vessel hull 35. A shelf portion of gusset plate 12 provides a surface onto which bottom slide 10 is welded. Top slide 14 is preferably a box-like structure having a top plate that protrudes past a corner of the box-like structure to intersect the hull. The protruding plate is preferably welded to a top shelf portion of gusset plate 12.

Preferably, flange 17 is bolted to pin support 6 to allow ease of installation and removal so that towing arm 2 can be disengaged from slide arm 6.

In operation, it is desirable to be able to dredge at approximately 65 feet below the surface of a water body. The length of towing arm 2 is selected so that it can form the hypotenuse of a right triangle, one leg of the right triangle being the distance from a pin connection between towing arm 2 and slide arm 6 and the desired dredging depth, and the other leg of the right triangle being the distance behind the pivot connection between towing arm 2 and slide arm 6 and the distance behind at which the dredge operates. When the vertical distance is 65 feet, the forward portion of dredging apparatus 4 should be at least 20 feet astern of the propellers to prevent cavitation due to rising air from the dredging apparatus. Preferably, towing arm support 8 is sized so that when towing arm 2 is horizontal dredge 4 connected to distal end of towing arm 2 is out of the water and very close to the stern of the vessel to allow ease of maintenance of the dredge.

Winching means 20 preferably includes cable connected between draw works (not shown) and dredging apparatus 4. Winching means 20 raises and lowers dredging apparatus 4 under powered control.

I claim:

1. A towing arm assembly, comprising:

(a) two towing arm supports, each support affixed to an opposite side of a towing vessel, each of the supports having a horizontal channel adapted to receive in sliding engagement a pin connected to a proximal end of a towing arm, and each of the supports adapted for receiving a locking member to lock the pin within the channel, thereby preventing any fore and aft motion of the proximal end of the towing arm;

(b) two towing arms, each having a proximal end and a second, oppositely disposed, distal end, each comprising a tube having a pin rigidly connected thereto at the proximal end for sliding engagement within the channel of a towing arm support, each of the towing arms being connected at its distal end to a dredging apparatus;

(c) two locking members, each adapted for locking a pin to one of the towing arm supports thereby allowing locking of the pin within the channel to prevent fore and aft movement of the proximal end of the towing arms;

(d) means for sliding each of the towing arms aft to allow a dredging apparatus connected thereto to be placed at a distance sufficiently behind the stern of the towing vessel to allow any substantial amount of forced air from the dredging apparatus to remain substantially clear of any stern propeller of the towing vessel;

(e) means for sliding each of the towing arms forward to allowing the dredging apparatus to be positioned near the stern of the vessel; and (f) means for raising and lowering the dredging apparatus.

* * * * *